US006196982B1

(12) United States Patent
Ball

(10) Patent No.: US 6,196,982 B1
(45) Date of Patent: Mar. 6, 2001

(54) VACUUM MASSAGER

(76) Inventor: Terry A. Ball, c/o Doug Breeze, 140 E. Third St., Dayton, OH (US) 45403

( * ) Notice: Subject to any disclaimer, the term of this patent is extended or adjusted under 35 U.S.C. 154(b) by 0 days.

(21) Appl. No.: 09/001,127

(22) Filed: Dec. 30, 1997

Related U.S. Application Data

(63) Continuation of application No. 08/550,275, filed on Oct. 30, 1995, now abandoned.

(51) Int. Cl.[7] ..... A61H 7/00

(52) U.S. Cl. ..... 601/6; 601/12; 601/69; 601/67

(58) Field of Search ..... 601/6, 7, 12, 134, 601/135, 154, 155, 159, 160, 9, 10, 67, 69

(56) References Cited

U.S. PATENT DOCUMENTS

| | | | |
|---|---|---|---|
| 809,360 | 1/1906 | Dible . | |
| 1,025,504 | 5/1912 | Birrell . | |
| 1,141,373 | 6/1915 | Behm . | |
| 1,704,960 | 3/1929 | Ackerman . | |
| 1,744,443 | 1/1930 | Businger . | |
| 2,031,957 | 2/1936 | Karlstrom | 15/13 |
| 2,232,218 | 2/1941 | Doty | 128/65 |
| 2,338,339 | 1/1944 | LaMere et al. | 128/64 |
| 2,561,034 | 7/1951 | Phillips | 128/32 |
| 2,566,600 | 9/1951 | Colon | 128/65 |
| 2,626,601 | 1/1953 | Riley | 128/38 |
| 2,655,145 | 10/1953 | Heger | 128/24.1 |
| 2,655,146 | 10/1953 | Force | 128/38 |
| 2,655,147 | 10/1953 | Rohrer | 128/67 |
| 2,951,257 | 9/1960 | Bodine | 15/404 |
| 2,972,346 | 2/1961 | Eddings | 128/38 |
| 3,052,234 | 9/1962 | Martinec | 128/32 |
| 3,481,326 | 12/1969 | Schamblin | 128/24.2 |
| 3,516,411 | 6/1970 | Adler | 128/404 |
| 3,716,048 | 2/1973 | Alonso | 128/49 |
| 3,841,322 | 10/1974 | Spelio | 128/40 |
| 4,003,373 | 1/1977 | Spelio | 128/40 |
| 4,296,743 | 10/1981 | Laslely | 128/30 |
| 4,469,092 | 9/1984 | Marshall et al. | 128/36 |
| 4,765,316 | 8/1988 | Marshall | 128/36 |
| 4,836,192 | 6/1989 | Abbate | 128/38 |
| 5,228,431 * | 7/1993 | Giarretto | 601/12 |

* cited by examiner

*Primary Examiner*—Mickey Yu
*Assistant Examiner*—Benjamin Koo

(57) ABSTRACT

The invention is a vacuum massage apparatus comprising a housing and a rotor. The housing includes a flexible portion defining a chamber having an open side and a flow path communicating with the chamber. The flexible portion is arcuate in shape and has a plurality of nodules projecting perpendicularly from its inner surface into the chamber. The rotor is supported by the housing in a flow path from the port. The rotor is rotatable about a rotor axis and has a center of gravity eccentric to the rotor axis. In preferred form, the flow path is coupled to a vacuum source such as the hose of a vacuum cleaner to provide suction in the chamber and a pressure difference across the rotor. One object of the invention to provide a massage apparatus which stimulates circulation as well as vibrating the skin.

4 Claims, 3 Drawing Sheets

VACUUM MASSAGER

CROSS-REFERENCE TO RELATED APPLICATIONS

This application is a continuation of Ser. No. 08/550,275, filed Oct. 30, 1995 now abandoned.

BACKGROUND OF THE INVENTION

1. Field of the Invention

This invention relates to the field of kinesitherapy, and more specifically to a vacuum massage apparatus having improved sealability and flexibility.

2. Description of the Related Art

Devices have been proposed to use the power generated by a domestic vacuum cleaner or other pneumatic source for massaging the skin of a user. Typically, such a device is in the form of an attachment to a vacuum cleaner hose which uses a reed valve or other obstruction in the flow path to generate pulses which are conducted by the device or the hose to the skin of the user. One drawback to such a device is that it vibrates without significantly lifting the skin so as to stimulate blood circulation or invigorate the blood vessels and hair follicles in the massaged region.

SUMMARY OF THE INVENTION

This drawback is overcome by means of a vacuum massage apparatus comprising a housing and a rotor. The housing includes a flexible portion defining a chamber having an open side and a flow path communicating with the chamber through a port. The rotor is supported by the housing in a flow path from the port. The rotor is rotatable about a rotor axis and has a center of gravity eccentric to the rotor axis. In preferred form, the flow path is coupled to a vacuum source such as the hose of a vacuum cleaner to provide suction in the chamber and a pressure difference across the rotor.

Since the chamber is defined by a flexible portion of the housing, the suction provided by the vacuum source tends to seal the flexible portion over the massaged region and to lift the skin to stimulate blood circulation in the massaged region. Furthermore, since the rotor has a center of gravity eccentric to the rotor axis, the pressure difference across the rotor causes it to vibrate due to the action of centrifugal force on the imbalanced distribution of mass in the rotor. The springiness of the flexible portion accentuates the effect of the vibration near the skin.

The flexible portion preferably defines an arcuate chamber conformable to the shape of the scalp or other region to be massaged. In an especially preferred embodiment, a plurality of symmetrically-arranged nodules project into the chamber along directions substantially perpendicular to an inner surface of the flexible portion. When a vacuum forms in the chamber, the nodules are pulled evenly onto the skin to provide uniform stimulation across the massaged region.

According to one embodiment, annular reservoirs are provided in the housing for dispensing oils or other scalp treatment fluids to the hair and scalp during the massage. According to another embodiment, a heat source such as a hot air source is coupled to the housing to heat the scalp during the massage.

Therefore, it is one object of the invention to provide a massage apparatus which stimulates circulation as well as invigorating blood vessels and hair follicles. This and other objects, features and advantages of the present invention will be described in further detail in connection with preferred embodiments of the invention shown in the accompanying drawings, wherein:

DETAILED DESCRIPTION OF THE PREFERRED EMBODIMENT

Figure 1:
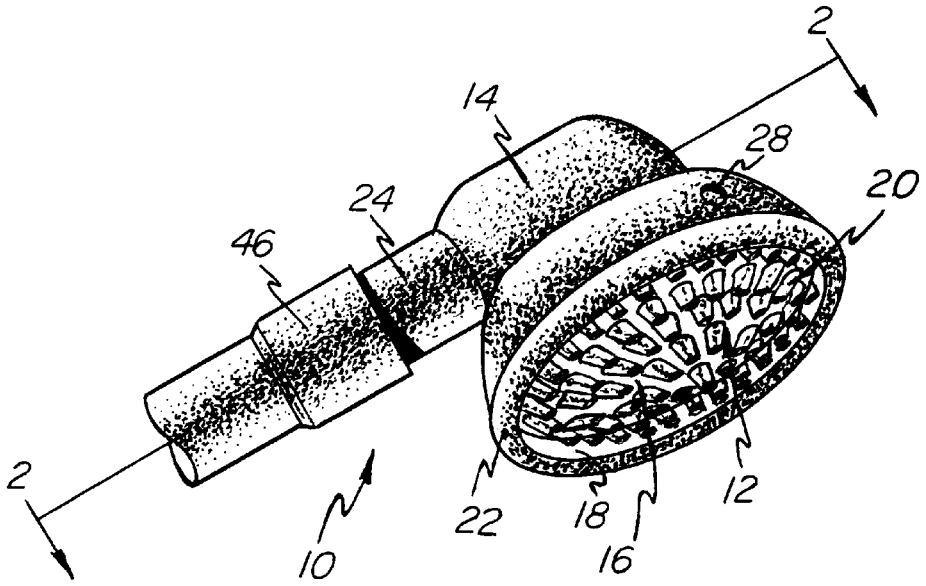
FIG. 1 is a perspective view of a first embodiment of a massage apparatus according to the present invention.
Figure 2:
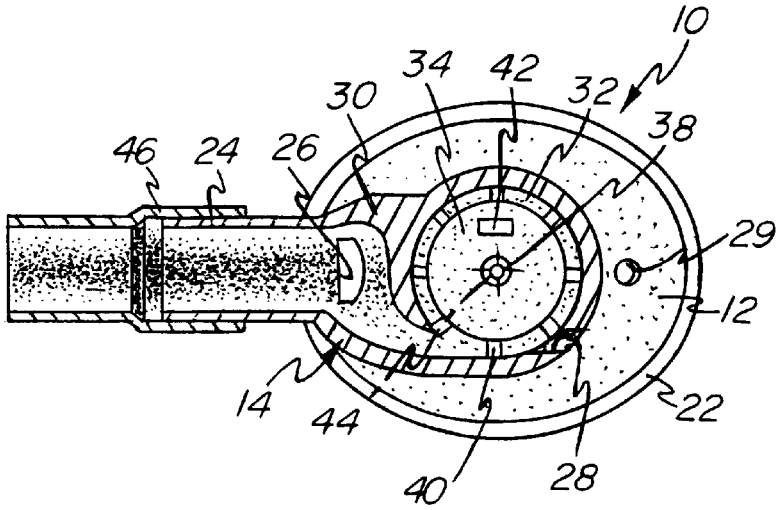
FIG. 2 is a top section view of the apparatus of FIG. 1 taken along the line 2—2.
Figure 3:
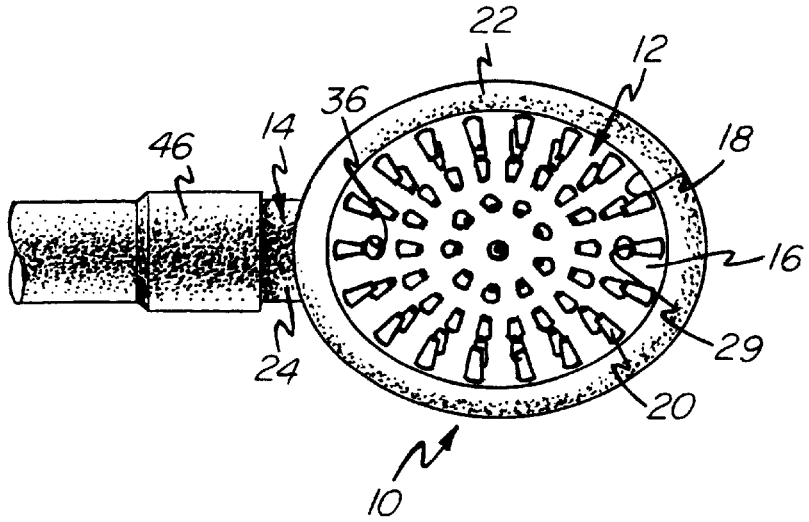
FIG. 3 is a bottom plan view of the apparatus of FIG. 1.

As shown in FIGS. 1–3, a first embodiment 10 of a vacuum massage apparatus includes a housing having a concave flexible portion 12 and a coupling 14, each preferably composed of a polymeric material such as plastic or rubber. While portion 12 has been specifically described as flexible, it will be understood that the coupling 14 may also be flexible, and, in fact, the coupling 14 may be injection molded with the concave flexible portion 12 as a unit. The concave flexible portion 12 defines a chamber 16 having an open side or end 18. A plurality of symmetrically-arranged nodules 20 project from the concave flexible member 12 into the chamber 16 for caressing a user's skin (not shown). Adjacent to, and surrounding, the open end 18 is a sealing lip 22 having a thickness greater than adjacent portions of the concave flexible portion 12 for engagement with the user's skin (not shown) to seal the concave flexible portion 12 over a massaged region (not shown).

As best shown in FIG. 2, the coupling 14 defines a flow path leading from an adaptor 24. The flow path includes three ports 26, 28, 29 as well as a baffle 30 defining a circular compartment 32 for housing a rotor 34. The port 26 aligns with a port 36 (FIG. 3) in the concave flexible member 12 so that the flow path communicates through the ports 26 and 36 with the chamber 16. The ports 28 and 29 communicate with the atmosphere and permit the user to control the strength of the vibration by partially or completely covering the port 28 with a finger. The baffle 30 is constructed to provide a tangential flow across the rotor 34 when a pressure difference is created between the port 28 and the adaptor 24.

The rotor 34 is rotatably supported in the circular compartment 32 on a shaft 38 anchored in the coupler 14. The rotor includes a plurality of vanes 40 for rotating the rotor 34 when engaged by tangential air flow from the port 28 toward the adaptor 24. In addition, the rotor 34 includes a weight 42 eccentric to the shaft 38 which is concentric with a rotor axis 44 When air flow causes the rotor 34 to rotate, the centrifugal force acting on the weight 42 causes the rotor 34 to vibrate against the shaft 38.

The adaptor 24 is coupleable to a vacuum source such as a hose 46 of a vacuum cleaner (not shown) to generate suction in the chamber 16 as well as a pressure difference between the port 28 and the adaptor 24.

As best shown in FIGS. 1 and 3, the concave flexible portion 12 is oval or oblong in shape, such that the chamber 16 is arcuate for conformity to the shape of the user's scalp or other massaged region. The nodules 20 project into the chamber along directions substantially perpendicular to the inner surface of the concave flexible portion 12 bounding the chamber 16.

A method for using the apparatus 10 will now be described. The open side 18 of the concave flexible portion 12 is placed against the region of skin (not shown) to be massaged. The adaptor 24 is coupled to the hose 46 of the vacuum cleaner (not shown) and the vacuum cleaner is activated to generate a pressure drop across the flow path through the coupler 14. The pressure drop causes air to flow through the port 28 and past the rotor 34. This flow of air causes the rotor 34 to rotate. As the rotor rotates, it vibrates the shaft 38 and the coupler 14. This vibration is conducted through the concave flexible portion 12 to the skin (not shown).

In addition, the suction generated by the vacuum cleaner (not shown) evacuates the chamber 16 and causes the concave flexible portion 12 to adhere against the skin (not shown). The force generated by the vacuum lifts the skin (not shown) in the massaged region (not shown) to stimulate blood flow and to invigorate the blood vessels and hair follicles. Furthermore, the evacuation of the chamber 16 flattens the concave flexible portion 12 against the skin (not shown), bringing the nodules 20 into contact to caress the massaged region (not shown). Since the chamber 16 is arcuate in shape and since the nodules 20 project perpendicularly from the inner surface of the concave flexible portion 12, the nodules 20 draw evenly against the skin to provide uniform stimulation across the massaged area. Air pressure acting on the sealing lip 22 presses the sealing lip 22 against the skin (not shown) to form a temporary air-tight seal to preserve the partial vacuum in the chamber 16.

Figure 4:
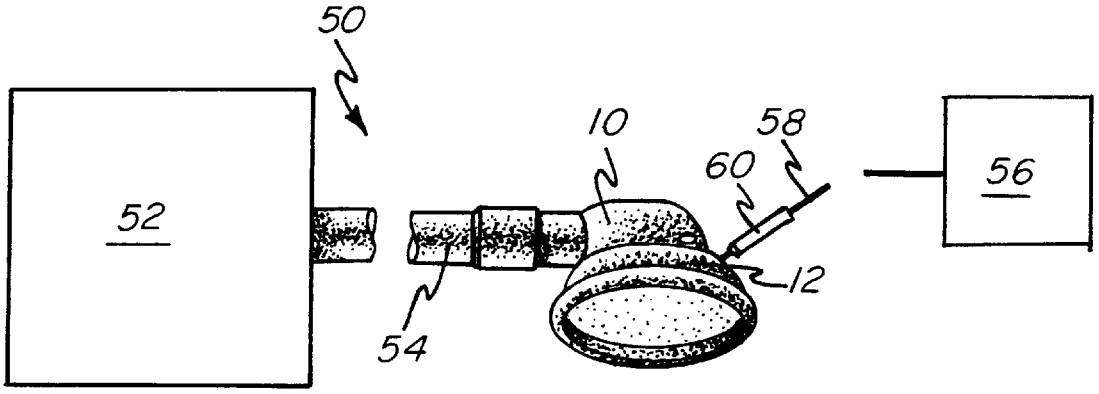
FIG. 4 is a top section view of a second embodiment of a massage apparatus having the outer appearance of FIG. 1, taken along the line 2—2 in FIG. 1, partially cut away to show annular reservoirs communicating with an interior of a housing of the apparatus.
Figure 5:
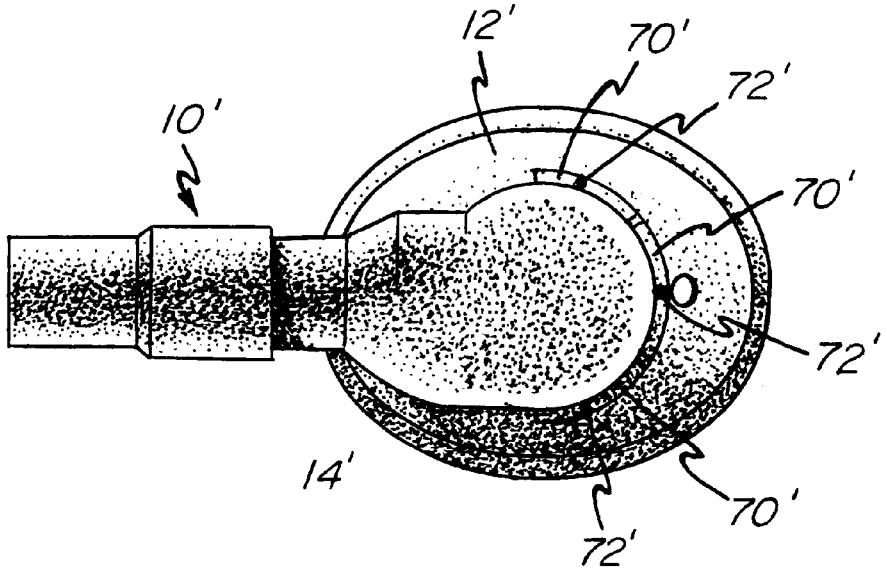
FIG. 5 is a schematic view of a warm massage system using the massage apparatus of FIG. 1.

A warm massage system 40 incorporating the massage apparatus 10 is shown schematically in FIG. 4. In addition to the massage apparatus 10, the warm massage system 40 includes a vacuum cleaner 42 coupled to the massage apparatus by means of a vacuum hose 44 and a hot air source such as a hair dryer 46 coupled to the concave flexible portion 12 of the massage apparatus. More specifically, the hot air source 46 is coupled to the concave flexible portion 12 through a hot air hose 48 and a coupling 50 which fits snugly into a port 52 in the concave flexible portion 12. During use, the hot air source 46 supplies warm air to an interior of the concave flexible portion 12 to provide a warm massage for the scalp.

A second embodiment 10' of the massage apparatus, having the same outer appearance as that of the embodiment 10 of FIG. 1, is shown in section in FIG. 4. The massage apparatus 10' includes a housing having a concave flexible portion 12' and a coupling 14', and is otherwise structurally identical to the embodiment 10 of FIG. 1 except that the housing includes a plurality of annular reservoirs 60' having ports 62' communicating with an interior (not shown) of the housing. In use, oils or other scalp or hair treatments (not shown) are injected into the reservoirs 60' through the ports 62', and are drawn out from the reservoirs 60' through the ports 62' onto the user's hair and scalp during the massage by the vacuum created in the housing. The injection of warm oils or scalp or hair treatments (not shown) into the reservoirs 60' serves the additional purpose of heating the scalp during the massage.

Various changes or modifications in the invention described may occur to those skilled in the art without departing from the true spirit or scope of the invention. The above description of preferred embodiments of the invention is intended to be illustrative and not limiting, and it is not intended that the invention be restricted thereto but that it be limited only by the true spirit and scope of the appended claims.

I claim:

1. An attachment for a vacuum cleaner comprising:

a) a concave flexible member defining a chamber having an open end, the concave flexible member including a first port for communication with a vacuum from the vacuum cleaner;

b) a coupling including an adaptor for engaging a hose of the vacuum cleaner;

c) a rotor mounted in the coupling for rotation about a rotor axis normal to the open side, the rotor having a center of gravity eccentric to the rotor axis and a plurality of vanes;

d) the coupling defining a first flow path for communication between the adaptor and the chamber through the first port;

e) the coupling including a baffle between the first port and the rotor, the baffle cooperating to define a second flow path from the adaptor tangential is to the rotor;

f) the coupling including a second port communicating with the atmosphere for supplying air to the second flow path; and g) the concave flexible member including a third port communicating with the atmosphere for supplying air to the first flow path.

2. The attachment as recited in claim 1 including a plurality of nodules projecting into the chamber and a sealing lip bounding the open end for sealing the vacuum around the plurality of nodules.

3. The attachment as recited in claim 1 including a plurality of nodules projecting perpendicularly from an inner surface of the concave flexible member into the chamber.

4. The attachment as recited in claim 1 including a sealing lip adjacent to, and surrounding, the open end.

* * * * *